US007922155B2

(12) United States Patent
Havlena

(10) Patent No.: US 7,922,155 B2
(45) Date of Patent: Apr. 12, 2011

(54) STEAM-GENERATOR TEMPERATURE CONTROL AND OPTIMIZATION

(75) Inventor: Vladimir Havlena, Prague (CZ)

(73) Assignee: Honeywell International Inc., Morristown, NJ (US)

( * ) Notice: Subject to any disclaimer, the term of this patent is extended or adjusted under 35 U.S.C. 154(b) by 950 days.

(21) Appl. No.: 11/787,100

(22) Filed: Apr. 13, 2007

(65) Prior Publication Data

US 2008/0251952 A1 Oct. 16, 2008

(51) Int. Cl.
*F22G 5/12* (2006.01)
*F01K 13/00* (2006.01)

(52) U.S. Cl. ..... 261/62; 60/660; 700/287; 122/479.1

(58) Field of Classification Search ..... 122/479.1; 60/653, 660; 261/62; 700/287
See application file for complete search history.

(56) References Cited

U.S. PATENT DOCUMENTS

| | | | | |
|---|---|---|---|---|
| 4,027,145 | A | 5/1977 | McDonald et al. | |
| 4,031,372 | A * | 6/1977 | Davis | 700/287 |
| 4,057,715 | A * | 11/1977 | Jones et al. | 700/290 |
| 4,274,259 | A * | 6/1981 | Silvestri, Jr. | 60/663 |
| 4,576,008 | A * | 3/1986 | Silvestri, Jr. | 60/662 |
| 4,653,276 | A * | 3/1987 | Sugano et al. | 60/665 |
| RE35,776 | E * | 4/1998 | Sugano et al. | |
| 6,712,604 | B2 | 3/2004 | Havlena | |

* cited by examiner

*Primary Examiner* — Steven B McAllister
*Assistant Examiner* — Seth Greenia
(74) *Attorney, Agent, or Firm* — Schwegman, Lundberg & Woessner P.A.

(57) ABSTRACT

A control method for boiler outlet temperatures includes predictive control of SH and RH desuperheater systems. The control method also includes control and optimization of steam generation conditions, for a boiler system, such as burner tilt and intensity, flue-gas recirculation, boiler fouling, and other conditions for the boiler. The control method assures a proportional-valve control action in the desuperheater system, that affects the boiler system.

6 Claims, 5 Drawing Sheets

STEAM-GENERATOR TEMPERATURE CONTROL AND OPTIMIZATION

BACKGROUND

Power generation plants often use steam turbines that are powered by steam generated in boilers from fuels such as coal, oil or gas. Both superheated and reheated steam are used in a steam turbine cycle. Steam temperatures are affected by the steam-heating facilities such as from a boiler. Power-generation conditions can also vary, however, based upon the actual state of the power-generation equipment, and in particular based upon the state of the boiler system and the steam turbines.

BRIEF DESCRIPTION OF THE FIGURES

Embodiments of this disclosure are illustrated by way of example and not limitation in the Figures of the accompanying drawings in which.

DETAILED DESCRIPTION

Figure 1:
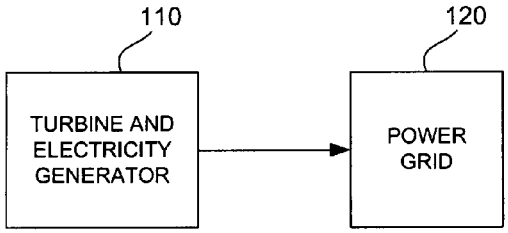
FIG. 1 shows a schematic diagram of a power-generation system that uses steam according to an embodiment.

A system and method for controlling and optimizing steam generation system is described herein. In method embodiments, the operation of a steam generation system includes manipulating system conditions to influence desuperheater cooling water control, to usually operate where symmetrical control action can be assured. Cooling water flow can only be positive, i.e. a negative flow cannot be realized to control a desuperheater. The method embodiments influence the steam generation system to operate in a region where a proportional-valve action for desuperheater cooling water is virtually assured to stabilize a steam output temperature.

In an embodiment, control is focused upon reheater (RH) desuperheater control, upon final superheater (SH) desuperheater control, and upon burner tilt control, to effect a proportional desuperheater cooling water valve action that can stabilize a steam output temperature. Further, optimization of the steam generation system includes addressing changing conditions such as overall boiler and turbine status.

In the following description, numerous specific details are set forth. The following description and the drawing figures illustrate aspects and embodiments sufficiently to enable those skilled in the art. Other embodiments may incorporate structural, logical, electrical, process, and other changes; e.g., functions described as software may be performed in hardware and vice versa. Examples merely typify possible variations, and are not limiting. Individual components and functions may be optional, and the sequence of operations may vary or run in parallel. Portions and features of some embodiments may be included in, substituted for or added to those of others. The scope of the embodied subject matter encompasses the full ambit of the claims and substantially all available equivalents.

The embodiments and their art-recognized equivalents of this description are divided into three sections. In the first section, an embodiment of a system-level overview is presented. In the second section, methods for using example embodiments are described. In the third section, an embodiment of a hardware and operating environment is described.

System-Level Overview

This section provides a system level overview of example embodiments.

FIG. 1 shows a schematic diagram of an electrical power-generation system 100 that uses steam according to an embodiment. The electrical power-generation system 100 includes steam-generated electricity that is attached to a power grid 120, according to an example embodiment.

The power-generation system 100 includes all the resources available to an entity to produce steam. For example, an entity may have a large power plant such as a coal-fired plant that generates boiler steam and electrical power, and an atomic power plant that produces energy and generates power and steam in another locale as well as smaller diesel fueled power plants. In other words, the power-generation system includes all of the various individual steam generating plants available to an entity. Various resources have various costs associated with the production of steam generation as it is being generated.

The electrical power-generation system 100 is connected to the power grid 120. The power grid 120 has all the various equipment necessary to distribute power from a power plant to individual businesses and home owners and the like. The power grid 120 includes transmission substations, high voltage transmission lines, power substations, switching towers, distribution busses, transformers and regulator banks as well as the power poles and various power lines. In some applications, the distributions lines are underground and there are transformer boxes located near the curve at every house or two.

Although conditions may vary within the steam-generation system 100, the disclosed embodiments teach a desuperheater cooling water system that achieves a proportional control action to treat superheated steam output temperatures. While the boiler system has control capabilities to meet changing duty, it also has optimization capabilities to meet changing boiler-system conditions. The proportional control action is achieved by restricting control and optimization of the boiler to achieve proportional valve action in the desuperheater cooling water flow.

The various embodiment of the steam-generation system 100 therefore include a separation between control of the desuperheater and reheater system with its unique control actions, and the control and optimization of the boiler system.

Figure 2:
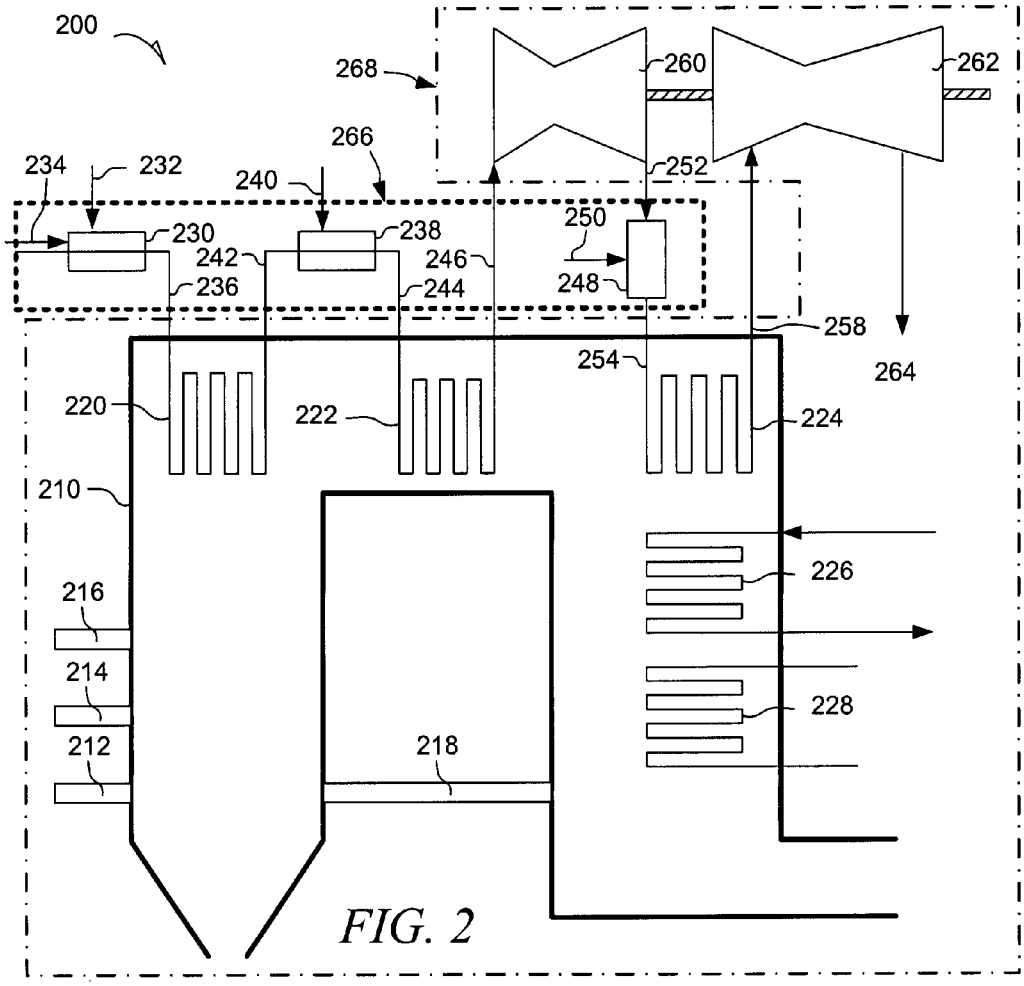
FIG. 2 shows a schematic diagram of a steam-generation system that uses control and optimization modules according to an embodiment.

FIG. 2 shows a schematic diagram of a steam-generation system 200 that uses control and optimization modules according to an embodiment. The steam-generation system 200 can be a steam-generation system such as that shown in FIG. 1.

A desuperheater system is depicted within the dashed line 206. An independently controlled and optimized boiler system is depicted within the dashed line 208.

A boiler 210 such as a coal-fired or an oil-fired boiler is depicted. Although the steam-generation system 200 depicts a boiler 210, embodiments are also applicable to other steam-generation systems such as a nuclear-fuel steam-generation system.

The boiler 210 has inputs such as fuel type 212, burner intensity 214, and burner tilt 216. Another input for the boiler 210 is a flue-gas recycle 218 functionality. According to an embodiment, the flue-gas recycle 218 functionality is controllable by a high-temperature ventilation system such as a fan that operates in harsh combustion-product environments.

Variability in the boiler system 208 can cause a changing boiler output status. Such variability can occur such as when a different fuel grade such as coal is used, or when different flue emission limits are imposed upon the boiler system 208. In an embodiment, variability is addressed by a cautious-optimization strategy that, for example, control emissions of carbon monoxide (CO) or nitrides of oxygen (NOx), and that operates the boiler system within specific emission limits. This cautious-optimization strategy can be one aspect of control and optimization for the boiler system. U.S. Pat. No. 6,712,604, by the inventor discloses various cautious-optimization strategies for such CO and NOx controls, and is incorporated herein by reference.

Another input for the boiler 210 includes a platen superheater 220 according to an embodiment. The platen superheater 220 can also be referred to as a superheat-1 (SH1) 220. Another input for the boiler 210 includes a final superheater 222. The final superheater 222 can also be referred to as a superheat-2 (SH2) 222, or as an outlet superheater 222.

Another input for the boiler 210 includes a reheat (RH) superheater 224 according to an embodiment. The RH superheater 224 can also be referred to as a reheater 224.

Another input for the boiler 210 is an economizer 226 that can pre-heat feed water to the boiler. Another input for the boiler 210 is an air heater 228 that can pre-heat combustion air that mixes with the fuel. The economizer 226 and the air heater 228 are depicted in FIG. 2 as being upstream from the flue-gas recycle functionality 218. In an embodiment, however, the location of the flue-gas recycle functionality 218 can be upstream from either or both of the economizer 226 and the air heater 228.

A related input is desuperheating cooling water flow to desuperheaters. An SH1 desuperheater 230 (also referred to as DSH SH1 230) depicts a cooling water flow 232. Steam flows to the RS desuperheater 230 include a DSH SH1 inlet flow 234 and a DSH SH1 outlet steam flow 236.

An SH2 desuperheater 238 (also referred to as DSH SH2 238) depicts a cooling water flow 240. Steam flows to the SH2 desuperheater 238 are DSH SH2 inlet steam flow 242 and DSH SH2 outlet steam flow 244. After the post-DSH SH2 flow 244 enters and exits the confines of the boiler 210, it is referred to as an turbine admission steam flow 246.

An RH desuperheater 248 (also referred to as a DSH RH 248) depicts a cooling water flow 250. Steam flows to the RH desuperheater 248 are DSH RH inlet steam flow 252 and DSH RH outlet steam flow 254. The post-DSH RH flow 254 is depicted as entering the confines of the boiler 210, passing through the RH tube bundle 224, and exiting the boiler 210 as an intermediate-pressure (IP) turbine feed flow 258.

A high-pressure (HP) turbine 260 and an IP and LP turbine 262 are also depicted. The HP turbine 260 receives the HP turbine steam flow 246, extracts enthalpy therefrom, and returns lower temperature steam as the HP-turbine exit flow 252. The IP and LP turbine 262 receives the IP turbine feed flow 258, extracts enthalpy therefrom, and LP outlet steam is condensed to water in condenser as the LP-turbine exit flow 264.

Figure 3:
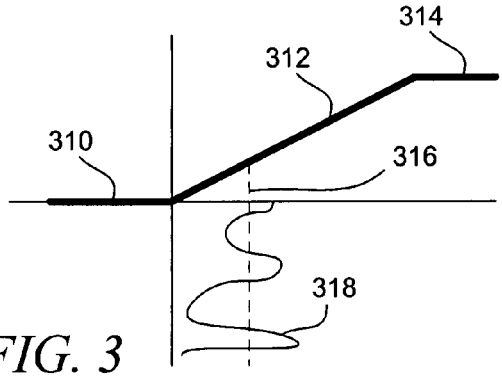
FIG. 3 shows a graph of the affect of desuperheater cooling water flow with minimum mean flow, as it is used to control superheated steam temperature within a desuperheater according to an embodiment.

FIG. 3 shows a graph of the affect of desuperheater cooling water flow with minimum mean flow, as it is used to control superheated steam temperature within a desuperheater according to an embodiment. DSH valve flow is depicted by a fully closed valve region 310, a proportional region 312, and a fully open valve region 314. The vertical axis represents desuperheater cooling water flow amounts, and the horizontal axis represents a cooling water flow set point as required for temperature correction for superheated steam as it exits a desuperheater.

The symmetry line 316 represents mean value of DSH water flow as it enters a desuperheater. The curved line represents required cooling water flow trajectory 318 of a given desuperheater, and it is depicted in arbitrary shape and amplitude.

Figure 4:
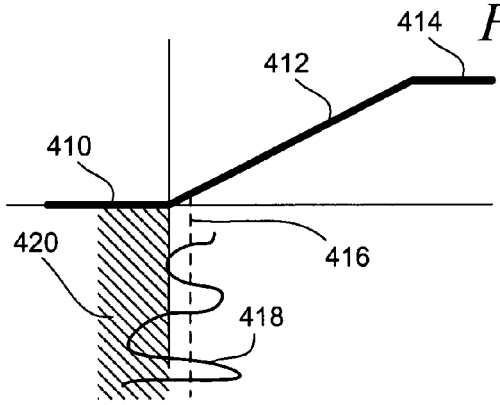
FIG. 4 shows a graph of the affect of desuperheater cooling water flow, as the control action is limited and within a fully closed valve range within a desuperheater according to an embodiment.

FIG. 4 shows a graph of the affect of desuperheater cooling water flow, as the control action is limited and within a fully closed valve range within a desuperheater according to an embodiment. DSH valve flow is depicted by a fully closed valve region 410, a proportional valve region 412, and a fully open valve region 414. The vertical axis represents desuperheater cooling water flow amounts, and the horizontal axis represents a cooling water flow set point as required for temperature correction for superheated steam as it exits a desuperheater.

The symmetry line 416 represents a mean value of the DSH water flow as it enters a desuperheater. The curved line represents required cooling water flow trajectory 418 of a given desuperheater, and it is depicted in arbitrary shape and amplitude. As the set point trajectory results in valve actions that include fully closed 410, a control limit 420 is noted. In this case, the steady state value is too low, and the minimum cooling will be limited, because a fully closed 410 valve action limits control-action. This would result in a decrease of a reheater DSH temperature, and a subsequent reduction of achievable cycle efficiency.

In an embodiment, equipment stress or thermodynamic inefficiencies are experienced. Such stresses and inefficiencies can be thermal shock of equipment from combining streams of significantly disparate temperature, or from feeding a stream to a unit where the temperatures are significantly disparate. In this embodiment, a desuperheater system is depicted at a state seen in FIG. 4, and a method of controlling the desuperheater system changes the location of the symmetry line 416 and the set point trajectory 418 from what is seen in FIG. 4, to what is seen in FIG. 3. In this method embodiment, controlling the desuperheater system includes affecting cooling water flow rates while avoiding a fully closed cooling water valve action, as seen by the observation at FIG. 4, followed by the response at FIG. 3.

Figure 5:
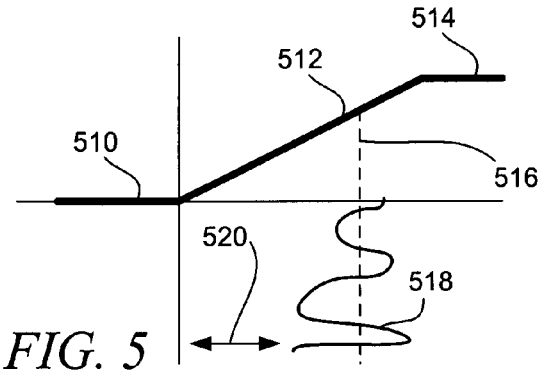
FIG. 5 shows a graph of the affect of desuperheater cooling water flow with maximum mean flow, as it is used to control superheated steam temperature above a more useful proportional valve range within a desuperheater according to an embodiment.

FIG. 5 shows a graph of the affect of desuperheater cooling water flow with maximum mean flow, as it is used to control superheated steam temperature above a proportional valve range within a desuperheater according to an embodiment. DSH valve flow is depicted by a fully closed valve region 510, a proportional valve region 512, and a fully open valve region 514. The vertical axis represents desuperheater cooling water flow amounts, and the horizontal axis represents a cooling water flow set point as required for temperature correction for superheated steam as it exits a desuperheater.

The symmetry line 516 represents a mean value of the DSH cooling water flow as it enters a desuperheater. The curved line represents a set point trajectory 518 of a given desuperheater, and it is depicted in arbitrary shape and amplitude. In this case, the steady state valve setting is higher than an optimal setting, and a discrepancy 520 is noted.

In this embodiment, a desuperheater system is depicted at a state seen in FIG. 5, and a method of controlling the desuperheater system changes the location of the symmetry line 516 and the set point trajectory 518 from what is seen in FIG. 5, to what is seen in FIG. 3.

Figure 6:
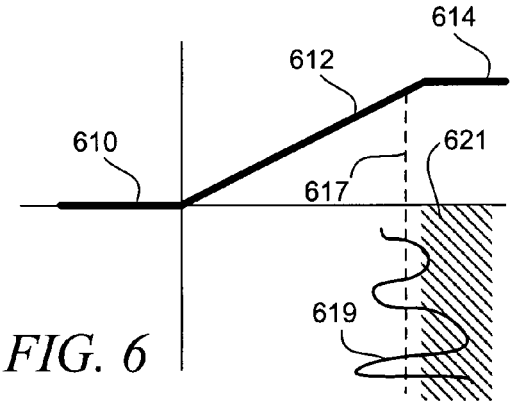
FIG. 6 shows a graph of the affect of desuperheater cooling water flow, as it control action is limited and within a fully open valve range within a desuperheater according to an embodiment.

FIG. 6 shows a graph of the affect of desuperheater cooling water flow, as it control action is limited and within a fully open valve range within a desuperheater according to an embodiment. DSH valve flow is depicted by a fully closed valve region 610, a proportional valve region 612, and a fully open valve region 614. The vertical axis represents desuperheater cooling water flow amounts, and the horizontal axis represents a cooling water flow set point as required for temperature correction for superheated steam as it exits a desuperheater.

The symmetry line 616 represents a mean value of DSH cooling water flow as it enters a desuperheater. The curved line represents a set point trajectory 619 of a given desuperheater, and it is depicted in arbitrary shape and amplitude. In this case, the steady state valve setting is higher than an optimal setting, such that a fully open valve has reach a control limit boundary, and a control limit 621 is noted.

In this embodiment, a desuperheater system is depicted at a state seen in FIG. 6, and a method of controlling the desuperheater system changes the location of the symmetry line 616 and the set point trajectory 619 from what is seen in FIG. 6, to what is seen in FIG. 3. It should be clear that a new set point trajectory could be established that is neater to the fully open cooling water valve setting, rather than nearer to the fully closed cooling water valve setting that is seen in FIG. 3.

Figure 7:
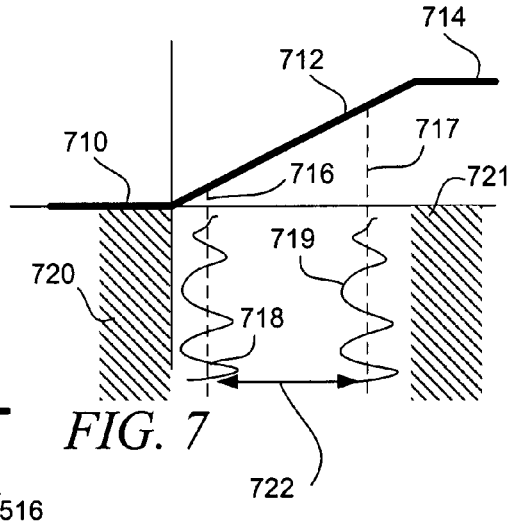
FIG. 7 shows a graph of the affect of desuperheater cooling water flow range, as it can be used to control superheated steam temperature without a limitation inside a more useful range within a desuperheater according to an embodiment.

FIG. 7 shows a graph of the affect of desuperheater cooling water flow range, as it can be used to control superheated steam temperature without a limitation inside a more useful range within a desuperheater according to an embodiment. DSH valve flow is depicted by a fully closed valve region 710, proportional valve region 712, and a fully open valve region 714. The vertical axis represents desuperheater cooling water flow amounts, and the horizontal axis represents a cooling water flow set point as required temperature correction for superheated steam as it exits a desuperheater.

A first symmetry line 716 represents minimum mean value of DSH cooling water as it enters a given desuperheater within the desuperheater system. A second symmetry line 717 represents maximum of DSH cooling water as it enters a given desuperheater within the desuperheater system. The depicted range 722 between the minimum and maximum flow lines 716, 717 is optimized to provide sufficient space to avoid DSH water flow limitation by lower and upper limit 720, 721 (feasible interval 722 amounts to a proportional valve action) as well as to provide maximum range within which boiler performance optimization can be done.

FIG. 7 therefore represents in an embodiment, a two-operating-zone model with a feasible interval 722 for a desuperheater system that has a single desuperheater. FIG. 7 can also represent in an embodiment, however, a two-desuperheater-unit, feasible interval 722 operating-zone for a desuperheater system. It can be appreciated that a feasible interval for a three-desuperheater-unit operating-zone can also be modeled in an embodiment, for a steam-generating system such as the steam-generation system 200 depicted in FIG. 2.

It can now be seen that a complex steam-generating system can have many disturbances, loads, and duties that may affect a feasible interval operating zone for a cooling water desuperheater system.

In an embodiment, control of the desuperheater system 206 includes optimization of RH desuperheater cooling water flow (typically minimization). During a given control action, burner tilt 216 may result in a too-low steam temperature for the final superheater 222, and some RH desuperheater cooling water flow may be needed.

Figure 8:
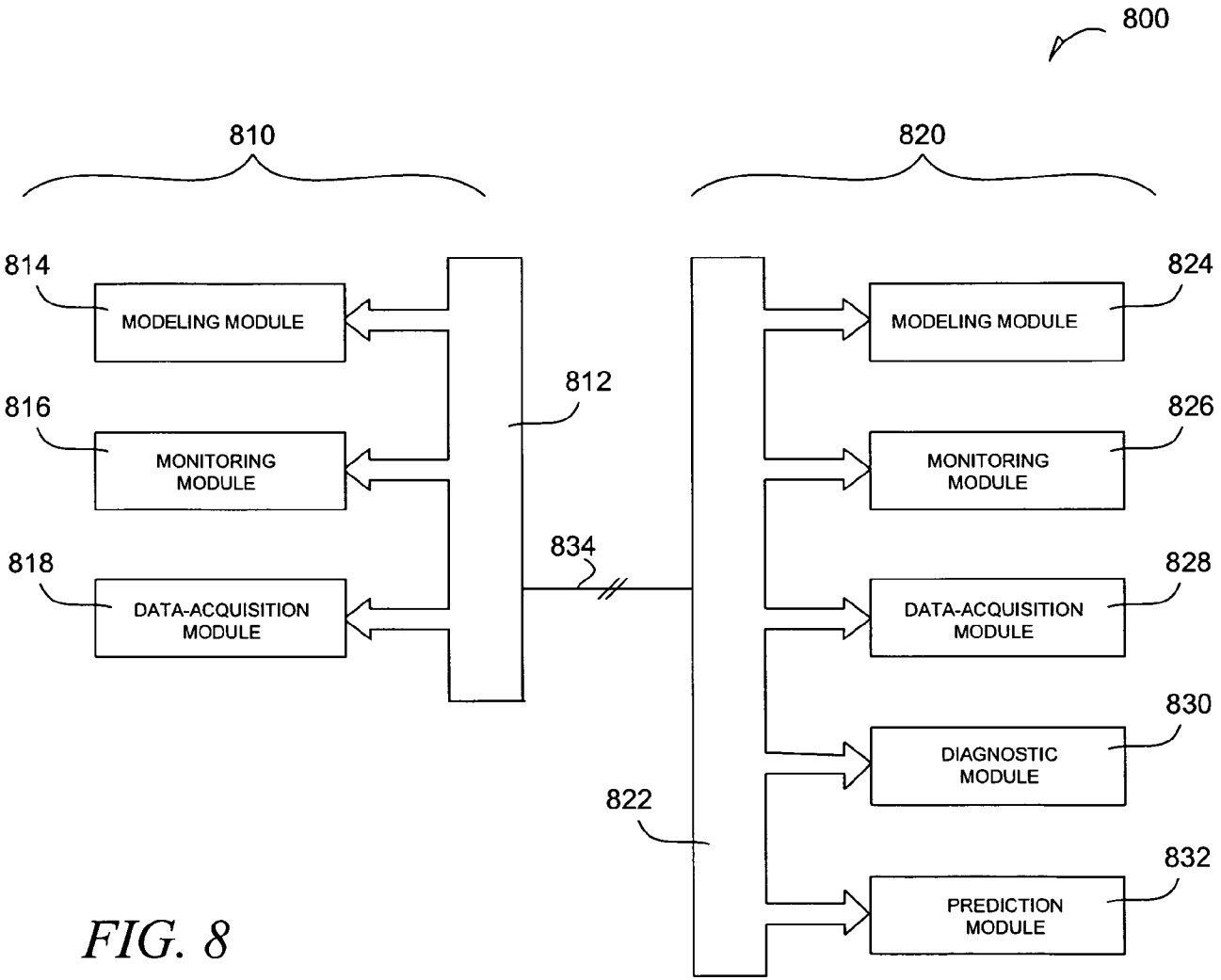
FIG. 8 shows a schematic diagram of control and optimization modules for the steam-generation system according to an embodiment.

FIG. 8 shows a schematic diagram of control and optimization modules for the steam-generation system according to an embodiment. The control and optimization modules 800 include a desuperheater control module 810 and a steam-generation control and optimization module 830.

Within the desuperheater control module 810, a first data bus 812 is used to communitively couple desuperheater control submodules, which include a desuperheater modeling submodule 814, a desuperheater monitoring submodule 816, and a desuperheater data acquisition submodule 818. Data can be transferred amongst the several submodules over the data bus 812 during the control process.

The modeling submodule 814 is used to model the process of spraying cooling water into a given desuperheater to adjust the temperature of superheated steam. The thermodynamics of such spraying processes are well understood. As illustrated in FIGS. 3-7, a symmetrical steam-temperature response is achievable by operating the boiler system 208 within parameters that assure desuperheater steam-temperature responses to be controllable within the feasible interval 720. The modeling submodule 814 also is used to describe heat-transfer conditions for a given desuperheater as external conditions affect the overall spraying process.

The monitoring submodule 816 monitors the overall conditions of a given desuperheater. The overall conditions include actual spraying-process data such as enthalpy changes and heat-transfer changes. The data-acquisition submodule 818 acquires a desuperheater duty for a selected period of time.

Within the steam-generation control module 820, a second data bus 822 is used to communitively couple steam-generation control submodules, which include a modeling submodule 824, a monitoring submodule 826, a data acquisition submodule 828, a data diagnostic submodule 830, and a prediction submodule 832. Data can be transferred amongst the several submodules over the second data bus 812 during the steam-generation control and optimization process.

The modeling submodule 814 is used to model a power generation apparatus in which it can also be used to model the various steam generation aspects of the power generation apparatus and, more particularly, the generation range for different equipment configurations and steam-generation duties. The monitoring submodule 824 monitors the internal consumption of power for a steam-generation system such as the boiler 210 depicted in FIG. 2. The monitoring submodule 824 also monitors the generation of a total amount of power from the steam-generation system such as the steam-generation system 100 depicted in FIG. 1. The total amount of power, in some embodiments, includes all the power that is generated over a selected time, such as a particular hour for a particular day. The data-acquisition submodule 828 acquires a power generation requirement for a selected period of time. The diagnostic submodule 830 operates several and various diagnostic tests of the steam-generation system 100.

In an embodiment, a diagnostic test that is directed by the diagnostic submodule 830 includes varying fuel type 212 as depicted in FIG. 2. Differences in fuel type 212 can be unavoidable when, for example a given grade of coal or fuel oil is what the market offers. Differences in fuel type 212 can also be selected, based upon optimization data that has been logged by the data-acquisition submodule 828. In an example embodiment, the boiler 210 is near to a scheduled down time for maintenance and cleaning, and boiler fouling is significant. A fuel grade can be selected based upon known diagnostics that will make heat transfer to the boiler more efficient, despite the pre-down time boiler fouling.

In an embodiment, a diagnostic test that is directed by the diagnostic submodule 830 includes varying burner intensity 214 as depicted in FIG. 2. Burner intensity 214 can be independent of boiler fouling, or it can be dependent upon boiler fouling. In an embodiment, the steam-generation system 100 has a significantly decreased duty, such as when a power company that is purchasing turbine-generated electricity, has an off-peak period. In such a time, burner intensity 214 can be reduced. Other example embodiments are convention as when to vary burner intensity 214.

In an embodiment, estimation of internal boiler parameters are monitored such as boiler fouling.

In an embodiment, a diagnostic test that is directed by the diagnostic submodule 830 is burner tilt 216. Burner tilt 216 can be a sub-function of burner intensity 214.

In an embodiment, a diagnostic test that is directed by the diagnostic submodule 830 is the flue-gas recycle 218 functionality. According to an embodiment, the diagnostic test evaluates the flue-gas recycle rate upon the overall efficiency of the boiler 110. In an embodiment, the diagnostic test evaluates the position near the economizer 226 and the air heater 228. The position from which the flue-gas is removed, whether it is upstream from the economizer 226 and the air heater, between them, or downstream from them, is logged into the diagnostic test.

Other data that are able to be acquired and evaluated within the diagnostic module 830, include superheater platen temperatures, such as the RS superheater platen 220, the outlet superheater platen 222, and the RH superheater 224.

The prediction submodule 832 predicts an optimal power execution trajectory over a remaining portion of time which is needed to meet a projected amount of power. The prediction submodule 832 utilizes data from all the other submodules in the steam-generation control module 820.

In an embodiment, the steam-generation control module 820 uses real-time control and optimization during the generation of steam. This real-time control and optimization is carried out independently of actions being effected within the desuperheater control module 810. Information from the desuperheater control module 810, however, can be acquired by the data-acquisition submodule 828 with the steam-generation control module 820, such as by a hard line 830, or through wireless communication.

As shown, each of the modules discussed above can be implemented in software, hardware or a combination of both hardware and software. Furthermore, each of the modules can be implemented as an instruction set on a microprocessor associated with a computer system or can be implemented as a set of instructions associated with any form of media, such as a set of instructions on a disk drive, a set of instructions on tape, a set of instructions transmitted over an Internet connection or the like.

Methods of Embodiments

This section describes methods embodiments. In certain embodiments, the methods are performed by machine-readable media (e.g., software), while in other embodiments, the methods are performed by hardware or other logic (e.g., digital logic).

Figure 9:
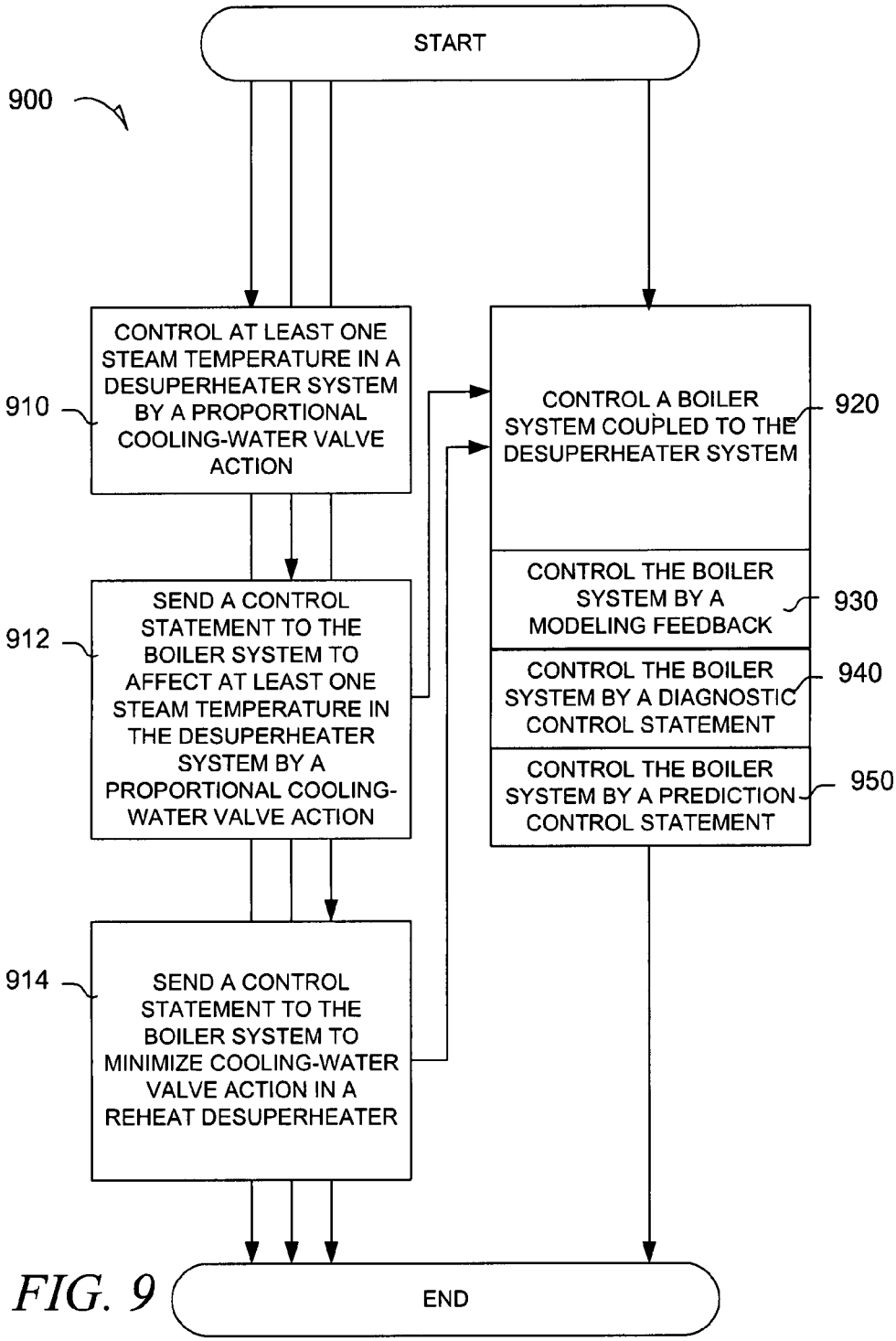
FIG. 9 is a method flowchart that illustrates method embodiment of this disclosure.

FIG. 9 is a method flowchart 900 that illustrates method embodiment of this disclosure. At 910, a desuperheater control action is carried out in a given desuperheater by controlling at least one steam temperature by a predictive, feed-forward control action that is based upon a system disturbance. In a non-limiting example, a look-up database of saturated and superheated steam data is referenced while a corrective action is taken to cause conditions of the given desuperheater to change from the output depicted in FIG. 4, to the output depicted in FIG. 3. In a nonlimiting example, a corrective action is taken to assure desuperheater cooling water flow to remain within a feasible interval, such as the feasible interval 720 depicted in FIG. 7.

At 912, the method includes sending a control statement to the boiler system, such that a corrective action is taken within the boiler system to cause cooling water control valve action to remain proportional and/or within the feasible interval that has been established.

At 914, the method includes sending a control statement within either of the boiler system or the desuperheater system, to minimize desuperheater cooling water flow in a reheater.

It should be clear that the control actions depicted in 910, 912, and 914, can be carried out singly, or in combination.

At 920, a boiler system control action is carried out. In an embodiment the boiler-system control action originates in the modeling submodule 824 such as by a feedback data statement that results in a control statement.

At 930, a boiler system control action is carried out. In an embodiment the boiler-system control action originates in the monitoring submodule 826 such as by a feedback data statement that results in a control statement.

At 940, a boiler system control action is carried out. In an embodiment the boiler-system control action originates in the data diagnostic submodule 830 such as by a feedback data statement that results in a control statement.

At 950, a boiler system control action is carried out. In an embodiment the boiler-system control action originates in the prediction submodule 832 such as by a database-lookup statement that results in a control statement.

Figure 10:
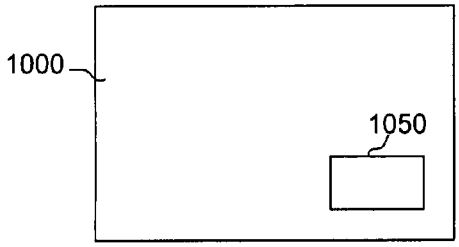
FIG. 10 is a schematic diagram illustrating a media having an instruction set, according to an example embodiment.

FIG. 10 is a schematic diagram illustrating a media having an instruction set, according to an example embodiment. A machine-readable medium 1000 includes any type of medium such as a link to the internet or other network, or a disk drive or a solid state memory device, or the like. A machine-readable medium 1000 includes instructions within and instruction set 1050. The instructions, when executed by a machine such as an information handling system or a processor, cause the machine to perform operations that include the control methods, such as the ones discussed in FIGS. 2-9.

In an example embodiment, a machine-readable medium 1000 that includes a set of instructions 1050, the instructions, when executed by a machine, cause the machine to perform operations including modeling the desuperheater system embodiments and also the steam-generation system embodiments.

Hardware and Operating Environment

This section provides an overview of the example hardware and the operating environment in which embodiments of the can be practiced.

Figure 11:
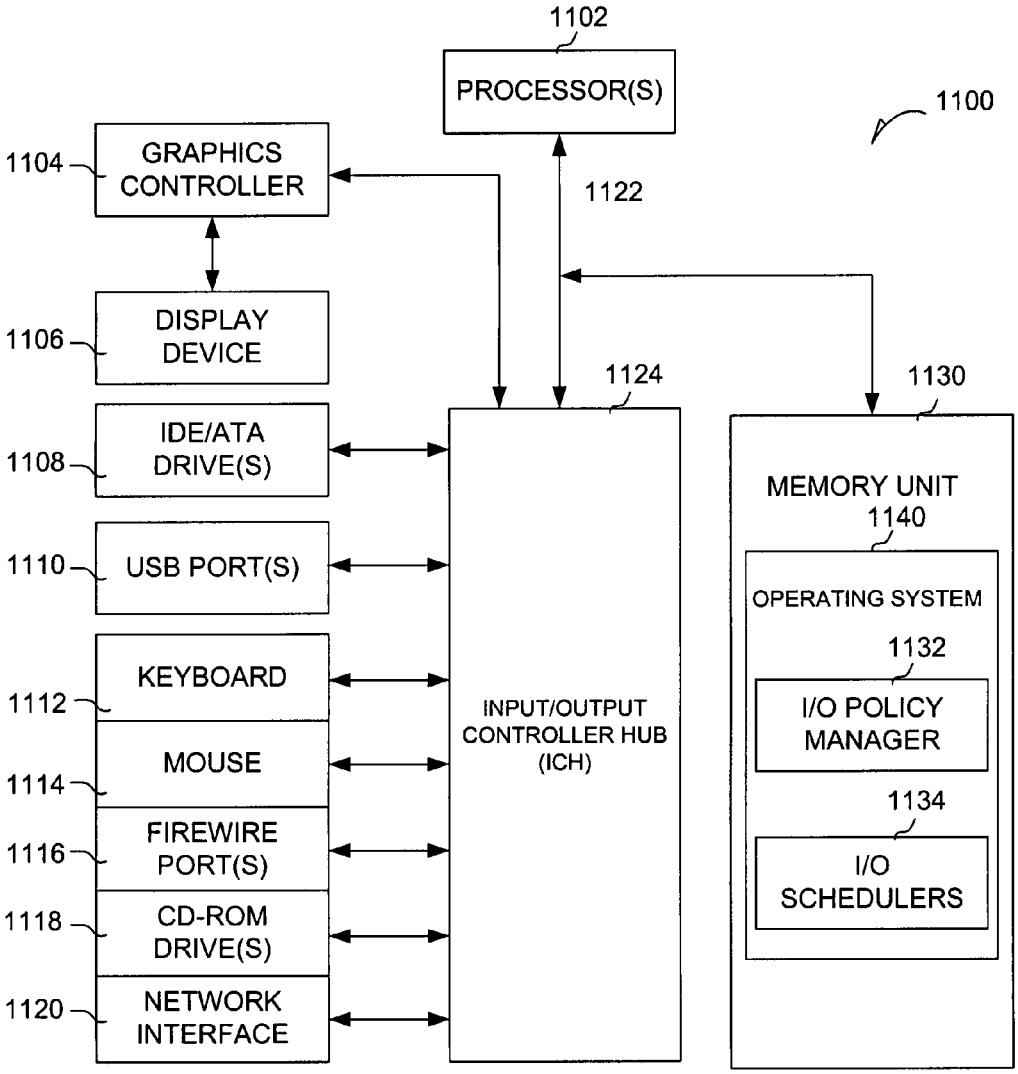
FIG. 11 illustrates an example computer system used in conjunction with certain example embodiments.

FIG. 11 illustrates an example computer system used in conjunction with desuperheater and steam-generation embodiments set forth in this disclosure. As illustrated in FIG. 10, computer system 1100 comprises processor(s) 1102. The computer system 1100 also includes a memory unit 1130, processor bus 1122, and Input/Output controller hub (ICH) 1124. The processor(s) 1102, memory unit 1130, and ICH 1124 are coupled to the processor bus 1122. The processor(s) 1102 may comprise any suitable processor architecture. The computer system 1100 may comprise one, two, three, or more processors, any of which may execute a set of instructions in accordance with desuperheater and steam-generation embodiments.

The memory unit 1130 includes an operating system 1140, which includes an I/O scheduling policy manager 1132 and I/O schedulers 1134. The memory unit 1130 stores data and/or instructions, and may comprise any suitable memory, such as a dynamic random access memory (DRAM), for example. The computer system 1100 also includes IDE drive(s) 1108 and/or other suitable storage devices. A graphics controller 1104 controls the display of information on a display device 1106, according to disclosed embodiments.

The Input/Output controller hub (ICH) 1124 provides an interface to I/O devices or peripheral components for the computer system 1100. The ICH 1124 may comprise any suitable interface controller to provide for any suitable communication link to the processor(s) 1102, memory unit 1130 and/or to any suitable device or component in communication with the ICH 1124. For one embodiment, the ICH 1124 provides suitable arbitration and buffering for each interface.

In an embodiment, the ICH 1124 provides an interface to one or more suitable integrated drive electronics (IDE) drives 1108, such as a hard disk drive (HDD) or compact disc read-only memory (CD ROM) drive, or to suitable universal serial bus (USB) devices through one or more USB ports 1110. In an embodiment, the ICH 1124 also provides an interface to a keyboard 1112, a mouse 1114, a CD-ROM drive 1118, and one or more suitable devices through one or more firewire ports 1116. The ICH 1124 also provides a network interface 1120 though which the computer system 1100 can communicate with other computers and/or devices.

In one embodiment, the computer system 1100 includes a machine-readable medium that stores a set of instructions (e.g., software) embodying any one, or all, of the methodologies for desuperheater and steam-generation systems described herein. Furthermore, software can reside, completely or at least partially, within memory unit 1130 and/or within the processor(s) 1102.

Thus, a system, method, and machine-readable medium including instructions for Input/Output scheduling have been described. Although the various desuperheater and steam-generation control and optimization systems has been described with reference to specific example embodiments, it will be evident that various modifications and changes may be made to these embodiments without departing from the broader scope of the disclosed subject matter. Accordingly, the specification and drawings are to be regarded in an illustrative rather than a restrictive sense.

What is claimed is:

1. A control system for a steam generator comprising:

a desuperheater control module, wherein the desuperheater control module controls at least one of an outlet desuperheater and a reheater (RH) desuperheater, wherein the desuperheater control module is based upon a predictive control action, and wherein the desuperheater control module is based upon a control action to affect a proportional-valve cooling water flow in the least one of the outlet desuperheater and the RH desuperheater;

a boiler-control module that is coupled to the desuperheater control module, wherein the boiler-control module controls variables including at least one of burner tilt, burner intensity, flue gas recirculation, superheater platen temperatures including at least one of an RS superheater platen, an outlet superheater platen, and RH superheater platen, boiler fouling, and turbine output status, and wherein the desuperheater control module uses feedback and diagnostic control algorithms; and wherein the desuperheater control module can send a control statement to the boiler-control module to assure proportional-valve cooling water flow control in at least one of the outlet desuperheater and the RH desuperheater.

2. The control system of claim 1, wherein the desuperheater control module includes control statements that:

optimize cooling water flow rates at the RH desuperheater, while improving efficiency of steam generator.

3. The control system of claim 1, wherein the desuperheater control module includes control statements that:

minimize cooling water flow rates at the RH desuperheater, while improving efficiency of steam generator.

4. The control system of claim 1, wherein the feedback diagnostic algorithm sends control statements for events selected from the group consisting of routine periodic diagnostics, peak duty diagnostics, boiler-system output status, and steam turbine output status anomaly diagnostics.

5. The control system of claim 1, wherein the control system is reduced to a machine-readable medium that includes a set of instructions, the instructions, when executed by a machine, cause the machine to perform operations of the control.

6. The control system of claim 1 wherein the desuperheater control module controls both the outlet desuperheater and RH desuperheater to assure proportional-valve cooling water flow control in both the outlet desuperheater and the RH desuperheater.

* * * * *